US006183403B1

(12) United States Patent
Dunn

(10) Patent No.: US 6,183,403 B1
(45) Date of Patent: Feb. 6, 2001

(54) VEHICLE EXERCISE SYSTEM

(76) Inventor: Paul Dunn, 1360 S. Ocean Blvd. #701, Pompano Beach, FL (US) 33062

( * ) Notice: Under 35 U.S.C. 154(b), the term of this patent shall be extended for 0 days.

(21) Appl. No.: 09/045,784

(22) Filed: Mar. 20, 1998

(51) Int. Cl.[7] ..... A63B 21/04
(52) U.S. Cl. ..... 482/121; 482/129; 482/904
(58) Field of Search ..... 482/121–129, 482/904

(56) References Cited

U.S. PATENT DOCUMENTS 5,571,064 * 11/1996 Holm ..... 482/904
5,743,838 * 4/1998 Willis ..... 482/124

FOREIGN PATENT DOCUMENTS

1421162 * 4/1965 (FR) ..... 482/904
8203510 * 4/1983 (NL) ..... 482/904

* cited by examiner

*Primary Examiner*—Jerome W. Donnelly

(57) ABSTRACT

An exercise system for use in an automobile or other vehicle comprising a generally flat, elongate door jamb member, a generally flat, elongate seat attachment member and at least one resilient tension member. The door jamb member includes an enlarged portion, with a thickness greater than the distance between the vehicle door and the vehicle door frame when the vehicle door is closed, on a first end zone of the door jamb member so as to prevent the first end zone from being pulled between the vehicle door and the vehicle door frame when the vehicle door is closed, and a magnetic pad on the outer end of the first end zone of the door jamb member structured and disposed to removably secure the outer end of the first end zone of the door jamb member to the vehicle roof. The seat attachment member includes a buckle, structured to secure a first end of the seat attachment member to the second opposite end of the seat attachment member, thereby securing the seat attachment member around the vehicle seat. Each tension member includes a handle at one end and is removably attached to the door jamb member or seat attachment member at the opposite end.

24 Claims, 7 Drawing Sheets

VEHICLE EXERCISE SYSTEM

BACKGROUND OF THE INVENTION

1. Field of the Invention

The present invention relates to exercise devices and, more particularly, to an exercise system for use in a vehicle.

2. Description of the Related Art

The importance of exercise to the maintenance of good health and general well being has received increased emphasis over the last several years. It is generally recognized that proper exercise may reduce many adverse health risks and contribute to a persons overall physical and mental well being. As such, the popularity of health clubs and home exercise equipment has increased greatly and many people now budget time to exercise into their daily schedule.

However, many people, although they would like to exercise, are unable to do so for a variety of reasons. One such reason is time. Between work, family and other obligations, many people simply do not have the time to travel to a health club and spend the time necessary to exercise. Additionally, exercising at home may not be an option for many of these people also because of the lack of time and because of typical household distractions, such as family, telephone, etc. Another reason people are unable to exercise is the cost. Many people cannot afford the cost associated with joining and remaining a member of a health club.

For many people, the only time available and, consequently, the only opportunity to exercise is while they are in their car or other vehicle. Thus, there is a need for an exercise system which will enable people to exercise while in a car or other vehicle.

Several devices have been developed which, to some extent, may address this need. For instance, U.S. Pat. No. 5,141,482 discloses a seat exerciser device comprising a first strap for attachment to a seat, a second strap for attachment around a person's chest and shoulders and a tension member having one end attached to the first strap and the opposite end attached to the second strap. In use, the person moves forward against the tension of the tension member, thereby exercising the chest and stomach muscles. However, this device is specifically designed to exercise only the chest and stomach muscles and does not provide the ability to exercise other muscles, such as those in the arms and legs.

Another exercise device for a vehicle is disclosed by U.S. Pat. No. 4,013,287. This device comprises an elastic member having a first end with a footrest and a second end attached to the underside of an automobile dashboard. In use, the driver of the automobile places his or her foot onto the footrest and extends the elastic member, thereby exercising certain leg muscles. However, this device is specifically designed to exercise only certain leg muscles and does not provide the ability to exercise other muscles, such as those in the arms, chest or shoulders. Additionally, the nature of this device appears to pose a potential safety risk because it includes a member which hangs down from an automobile dashboard in the vicinity of the drivers legs, the gas pedal and the brake, potentially impeding the drivers ability to properly move his or her legs and access the gas pedal and brake. Furthermore, the device is designed to be bolted or similarly mounted to the underside of the automobile dashboard, posing assembly and mounting difficulties and preventing use of the device elsewhere.

Other exercise devices, such as those disclosed in U.S. Pat. Nos. 5,324,243 and 5,171,295, were designed for use with chairs and may be adapted for use with automobile seats. However, these devices include several elements and members and, consequently, are bulky, cumbersome, unattractive, difficult to install and not easily transportable.

Although these prior art devices are useful for their intended purposes, none has proven to be entirely effective. Specifically, as discussed above, these devices are either limited to the exercise of certain specifically designated muscles, dangerous, bulky, cumbersome, unattractive, difficult to install or not easily transportable.

Accordingly, there is still a need in the art for an exercise system which will enable people to exercise while in a car or other vehicle. Any such system should be safe, unobtrusive and attractive, simple to install and operate, easily transportable and should provide the ability exercise various different muscles, including those in the arms, legs, chest and shoulders. To maximize the range of muscles which can be exercised, any such system should also provide a wide range of vantage points from which the exercises are to be initiated, i.e. different arm and leg positions, rather than the limited positions of the prior art devices. The present invention is particularly suited to overcome those problems which remain in the art in a manner not previously known.

SUMMARY OF THE INVENTION

The present invention is directed towards a new and improved exercise system for use in a motor vehicle comprising a generally flat, elongate door jamb member, a generally flat, elongate seat attachment member and at least one resilient tension member. The door jamb member is constructed of nylon webbing and includes an enlarged portion, with a thickness greater than the distance between the vehicle door and the vehicle door frame when the vehicle door is closed, on a first end zone of the door jamb member so as to prevent the first end zone from being pulled between the vehicle door and the vehicle door frame when the vehicle door is closed, and a magnetic pad on the outer end of the first end zone of the door jamb member structured and disposed to removably secure the outer end of the first end zone of the door jamb member to the vehicle roof The seat attachment member is also constructed of nylon webbing and includes a buckle, structured to secure a first end of the seat attachment member to the second opposite end of the seat attachment member, thereby securing the seat attachment member around the vehicle seat. Each tension member includes a handle at one end and is removably attached to the door jamb member or seat attachment member at the opposite end.

It is an object of the present invention to provide a new and improved exercise system which has all of the advantages of the prior art cover devices and none of the disadvantages.

It is another object of the present invention to provide an exercise system which will enable people to exercise while in an automobile or other vehicle.

It is a further object of the present invention to provide an exercise system for use in a vehicle which is safe, unobtrusive and attractive.

It is also an object of the present invention to provide an exercise system for use in a vehicle which provides a wide range of vantage points from which the exercises are to be initiated so as provide the ability exercise various different muscles, including those in the arms, legs, chest and shoulders.

It is yet another object of the present invention to provide an exercise system which is inexpensive, lightweight, simple to operate and easily transportable.

These and other objects and advantages of the present invention will become more readily apparent in the description which follows.

BRIEF DESCRIPTION OF THE DRAWINGS

For a fuller understanding of the nature of the present invention, reference should be had to the following detailed description, taken in connection with the accompanying drawings in which.

Like reference numerals refer to like parts throughout the several views of the drawings.

DETAILED DESCRIPTION OF THE PREFERRED EMBODIMENT

Figure 1:
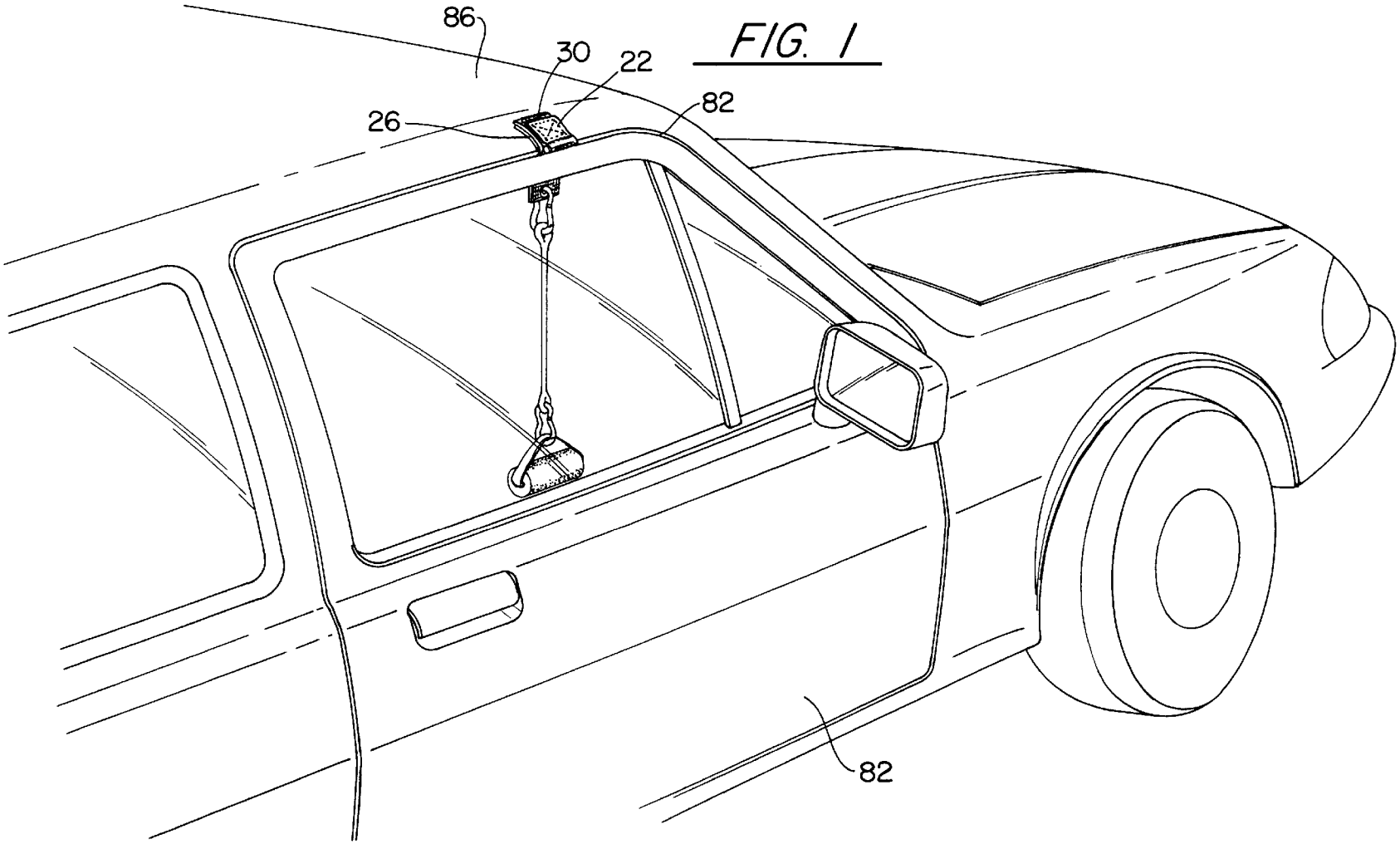
FIG. 1 is a perspective view of the outside of a vehicle showing the door jamb member of the present invention secured between the vehicle door and the vehicle door frame.
Figure 2:
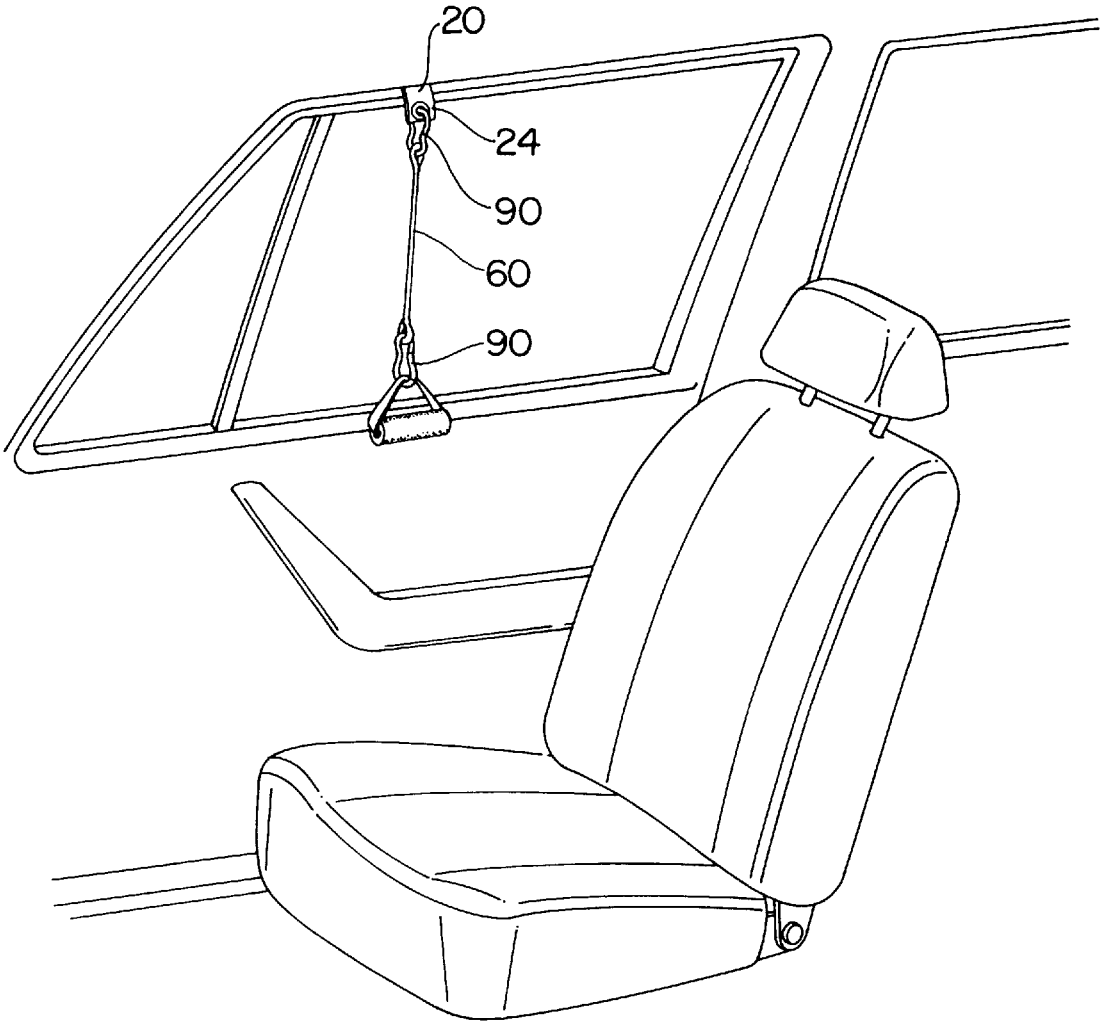
FIG. 2 is a perspective view of the inside of a vehicle showing the door jamb member of the present invention secured between the vehicle door and the vehicle door frame.
Figure 3:
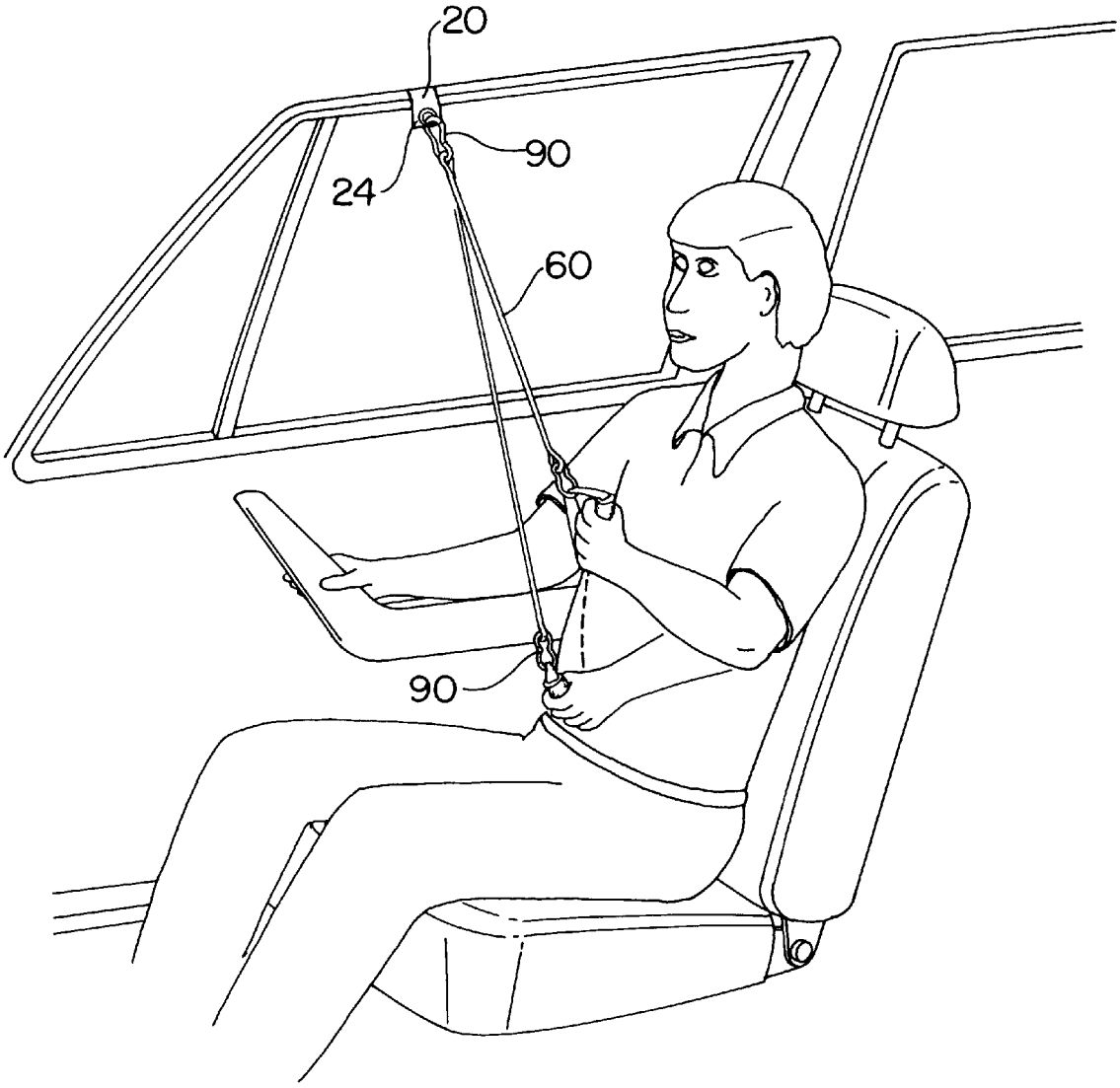
FIG. 3 is a perspective view of the inside of a vehicle showing the door jamb member and attached tension member in an extended and non-extended positions.
Figure 4A:
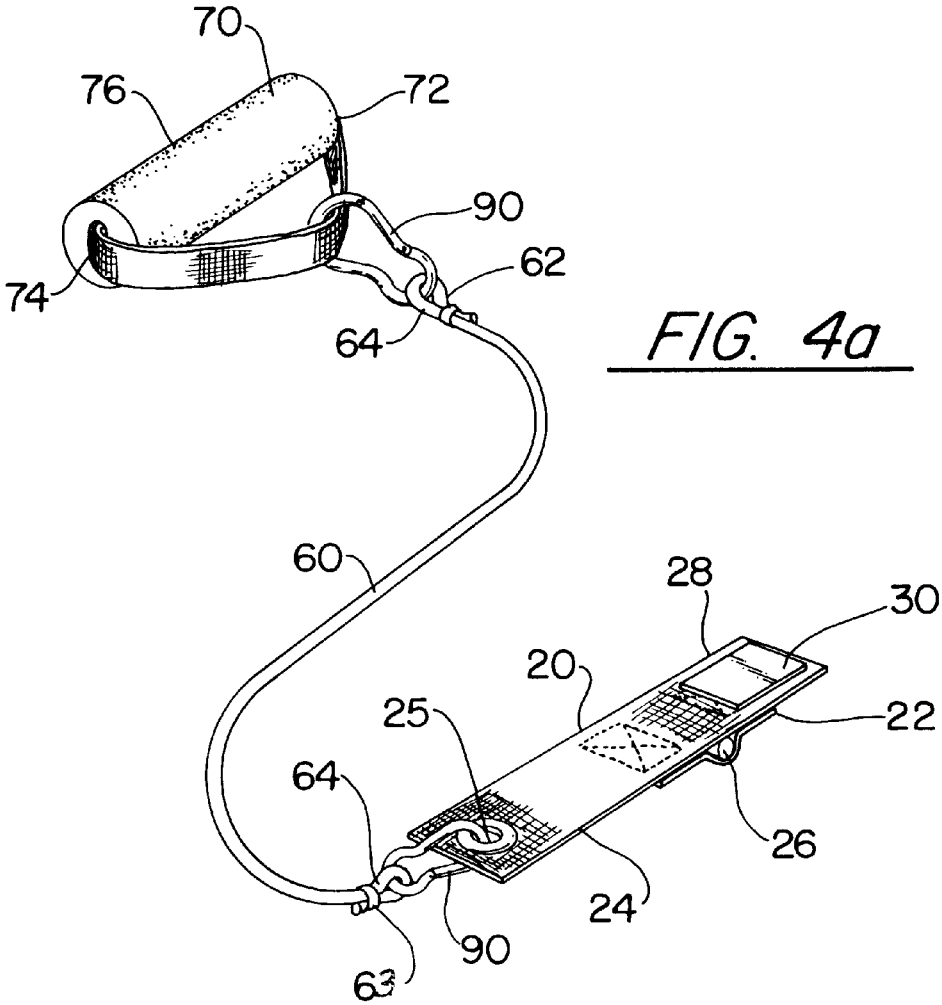
FIG. 4*a* is a perspective view of the door jamb member of the present invention.
Figure 4B:
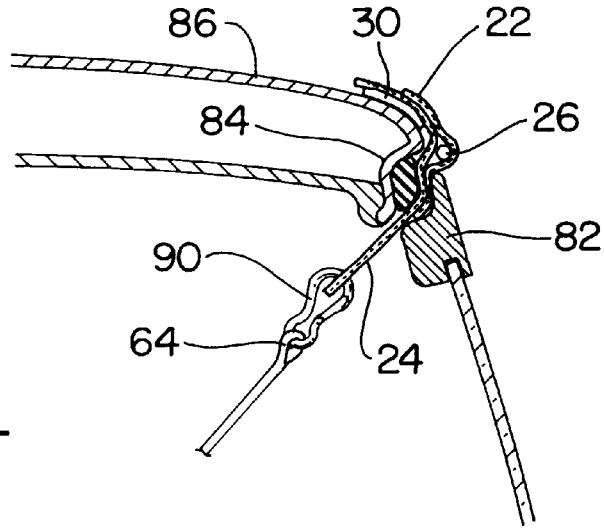
FIG. 4*b* is a cross sectional view, taken across the line 4*b*–4*b* of FIG. 1, showing the door jamb member of the present invention secured between the vehicle door and the vehicle door frame.
Figure 5:
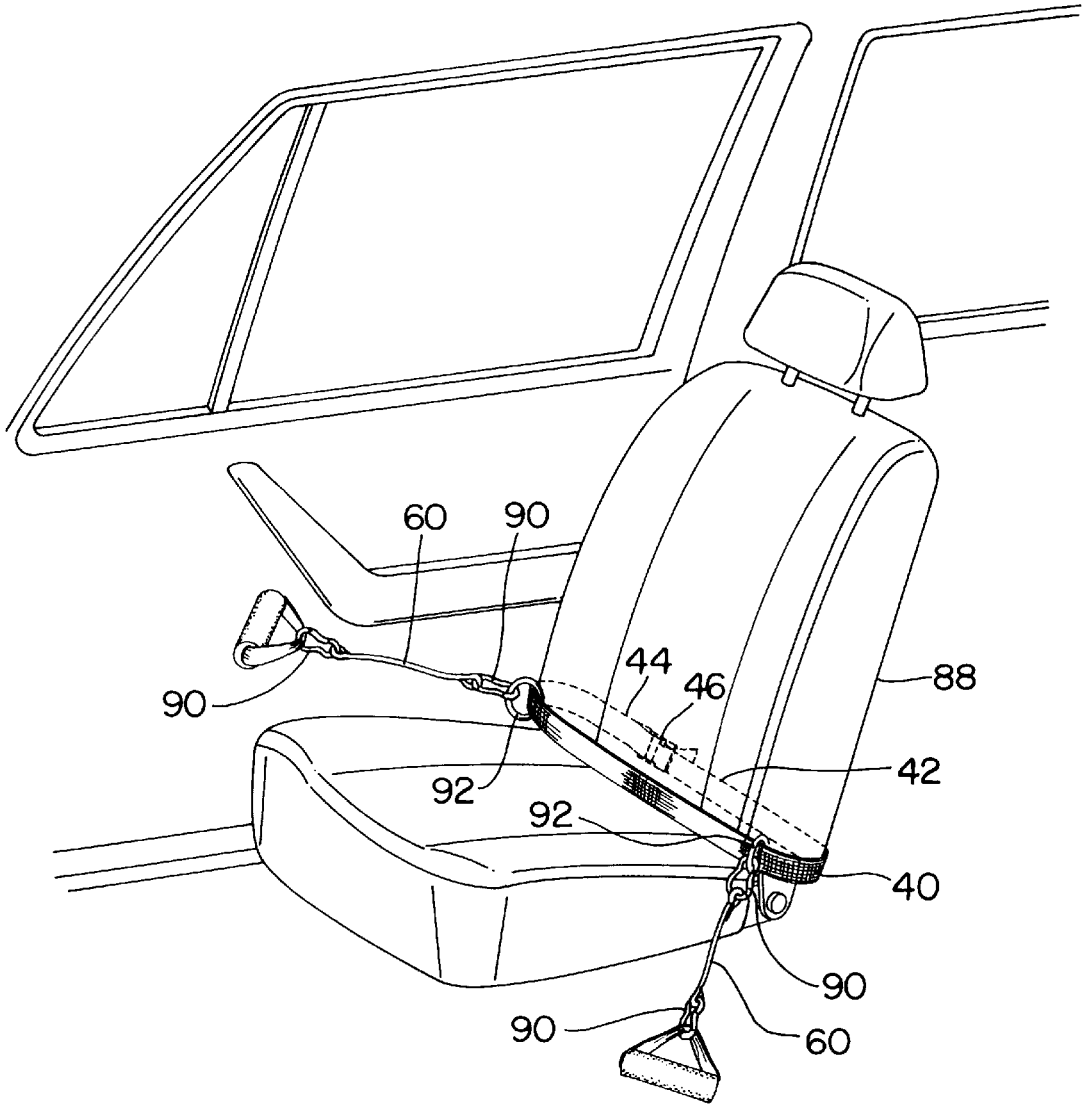
FIG. 5 is a perspective view of the inside of a vehicle showing the seat attachment member and attached tension members of the present invention.
Figure 6:
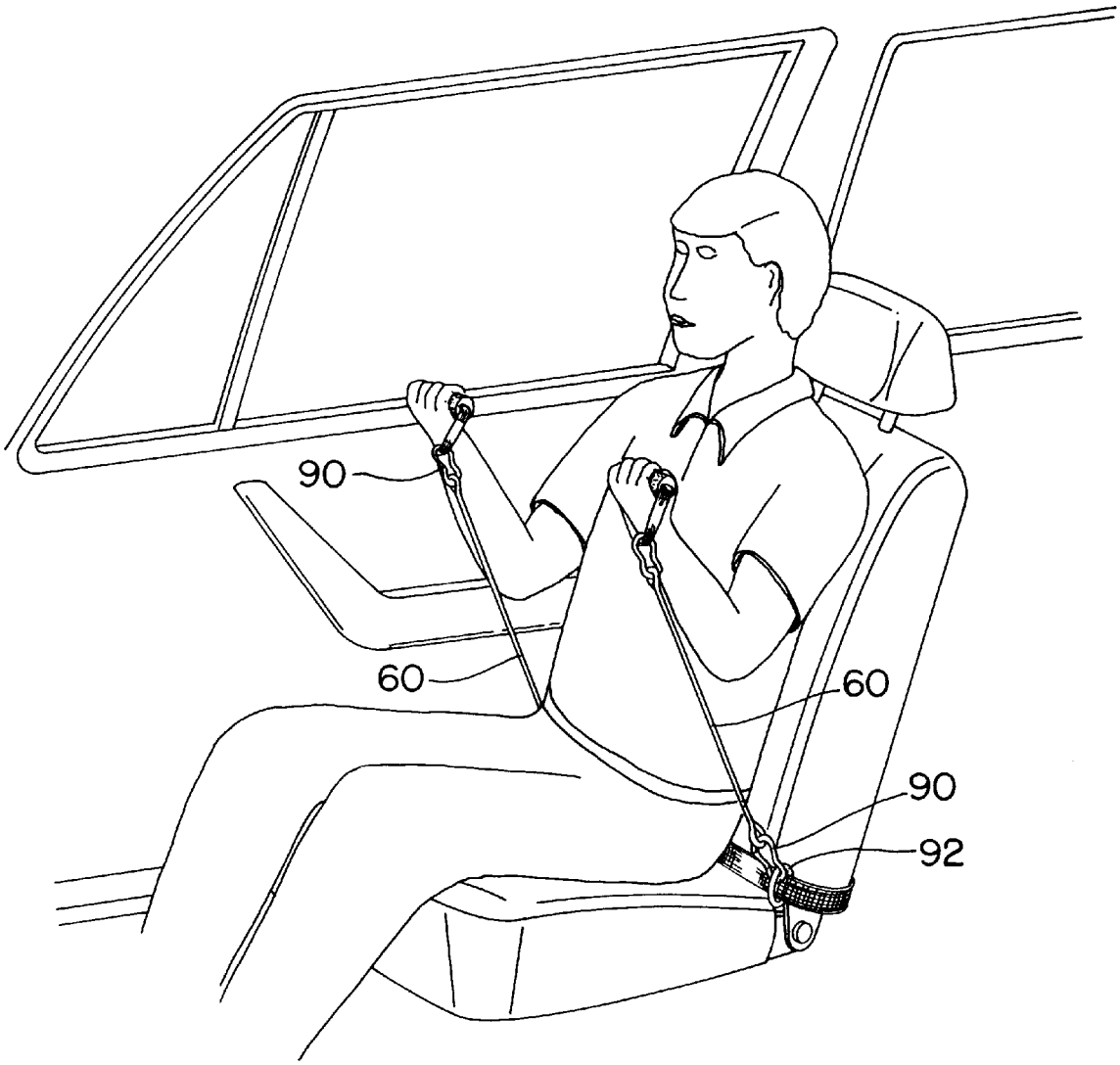
FIG. 6 is a perspective view of the inside of a vehicle showing the seat attachment member and attached tension members in an extended position.
Figure 7:
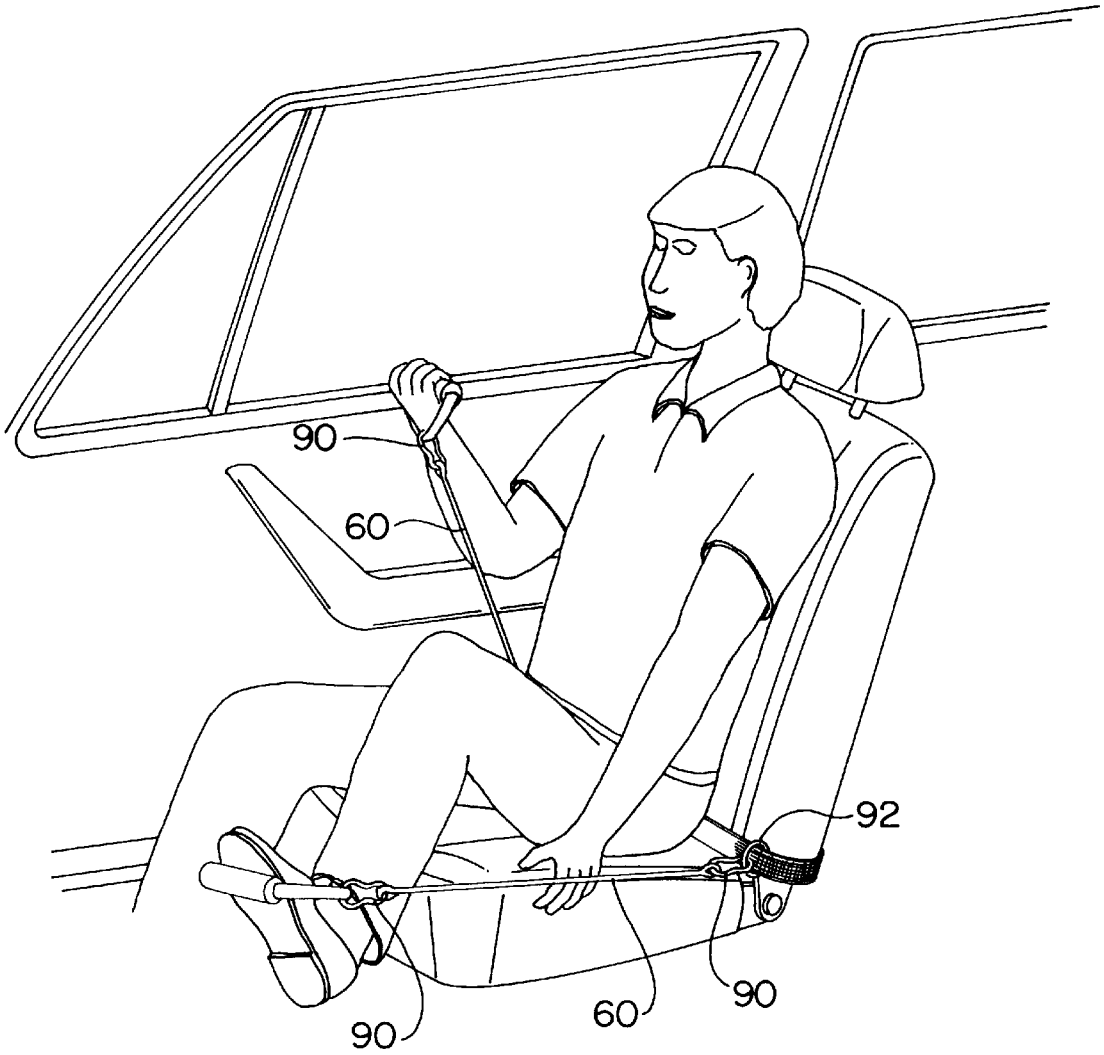
FIG. 7 is a perspective view of the inside of a vehicle showing the seat attachment member and attached tension members for use with arm and leg exercises.

As shown in FIGS. 1–7, the present invention is directed towards a new and improved exercise system 10 for use in an automobile or other vehicle which comprises a generally flat, elongate door jamb member 20, a generally flat, elongate seat attachment member 40 and at least one resilient tension member 60. The door jamb member 20 includes a first end zone 22, an opposite second end zone 24 and an enlarged portion 26, with a thickness greater than the distance between the vehicle door 82 and the vehicle door frame 84 when the vehicle door 82 is closed, on the first end zone 22. The door jamb member 20 is structured to be secured between the vehicle door 82 and the vehicle door frame 84, with the first end zone 22 outside of the vehicle 80 and the second end zone 24 inside the vehicle 80, when the vehicle door 82 is closed. The enlarged portion 26 is structured to prevent the first end zone 22 from being pulled between the vehicle door 82 and the vehicle door frame 84 when the vehicle door 82 is closed. In the preferred embodiment, the enlarged portion is comprised of a dowel secured within the door jamb member. However, the enlarged portion may, alternatively, be constructed by any other suitable means.

The door jamb member 20 also includes a magnetic pad 30 on the outer end 28 of the first end zone 22. The magnetic pad 30 is structured and disposed to removably secure the outer end 28 of the first end zone 22 to the vehicle roof 86 or to any other metal portion of the vehicle, such as the door frame, so as to maintain the outer end 28 of the first end zone 22 in place when opening the vehicle door 82.

The door jamb member 20 is preferably constructed of nylon webbing but may, alternatively, be constructed of any other suitable material.

The seat attachment member 40 includes a first end 42, an opposite second end 44 and a buckle 46, structured to secure the first end 42 to the second end 44, thereby securing the seat attachment member 40 around the vehicle seat 88. The seat attachment member 40 is preferably constructed of nylon webbing but may, alternatively, be constructed of any other suitable material.

Each tension member 60 is preferably constructed of elastic tubing, such as surgical tubing, but may, alternatively, be constructed of any other suitable resilient material capable of proving the desired resistance. A grip or handle 70 is attached to one end 62 of each tension member 60. The grip or handle 70 is preferably constructed of a length of nylon webbing having a pair of opposite ends 72, 74 attached to one another so as to form an essentially closed loop which an exerciser may grip. A cylindrical shaped tube 76 is positioned around a portion of the nylon webbing to improve the gripping capabilities of the exerciser. The tube 76 is preferably constructed of a soft foam-type material, such as neoprene, but may, alternatively, be constructed of any other suitable material.

The opposite end 63 of the tension members 60 are attached to either the seat attachment member 40 or the second end zone 24 of the doorjamb member 20, depending upon the particular muscles to be exercised. Various universal attachment means may be utilized. For instance, a loop connector 90, similar to those used by climbers, may attach to an o-ring 92 mounted around the seat attachment member 40 and a loop on the end 64 of the tension member 60, thereby removably securing the tension member 60 to the seat attachment member 40. Similarly, the loop connector 90 may attach the loop on the end 64 of the tension member 60 to a hole 25 in the second end zone 24 of the door jamb member 20, thereby removably securing the tension member 60 to the door jamb member 40. A protective cover (not shown), constructed of rubber, vinyl, cloth or any other suitable material, may be inserted over the connectors and/or o-rings to prevent the scratching, chipping or breaking of the vehicle windows upon the inadvertent swinging or snapping of the tension members 60.

In use, the exerciser closes the vehicle door 82 with the door jamb member 20 between the vehicle door 82 and the vehicle door frame 84 and the enlarged portion 26 outside of the vehicle 80 and the second end zone 24 inside the vehicle 80. The magnetic pad 30 is secured to the vehicle roof 86 to prevent the outer end 28 from flapping in the wind. After attaching the tension member 60 to the second end zone 24 of the door jamb member 20, the exerciser may stretch the tension member 60 in the direction necessary to exercise the desired muscles. The enlarged portion 26 holds the door jamb member 20 in place and prevents the exerciser from pulling the door jamb member into the vehicle 80. Similarly, the exerciser may attach the seat attachment member 40 around the vehicle seat 88, attach the tension member 60 to the seat attachment member 40 and stretch the tension member 60 in the direction necessary to exercise the desired muscles.

Tension members 60 of varying lengths may be utilized to accommodate exercisers of different sizes and to provide for the exercise of different muscles. For instance, shorter lengths will be appropriate when exercising arm muscles, whereas longer lengths would be necessary to exercise leg muscles. Similarly, tension members 60 of varying resilience may be utilized to provide for increased or decreased tension. Each tension member 60 is interchangeable and may be utilized with either the door jamb member 20 or the seat attachment member 40.

The door jamb member 20, seat attachment member 40 and tension members 60 may be of any desired color and include any desired indicia so as to be aesthetically pleasing to the exerciser.

Various changes may be made within the spirit and scope of the invention as described above.

What is claimed is:

1. An exercise system for use in a motor vehicle comprising:

a generally flat, elongate door jamb member having a first end zone, an opposite second end zone and means for preventing said first end zone from being pulled between a vehicle door and a vehicle door frame when said vehicle door is closed, said door jamb member being structured to be secured between said vehicle door and said vehicle door frame, with said first end zone outside of said vehicle and said second end zone inside said vehicle, when said vehicle door is closed, said first end zone having an outer end and a magnetic pad on said outer end said magnetic pad being structured and disposed for removably securing said outer end to a vehicle roof;

at least one resilient tension member;

means for gripping said tension member; and means for removably attaching said tension member to said second end zone of said door jamb member.

2. An exercise system for use in a motor vehicle as recited in claim 1 further comprising a generally flat, elongate seat attachment member structured for attachment to a vehicle seat and means for removably attaching said tension members to said seat attachment member, said seat attachment member having a first end, an opposite second end and means for removably securing said seat attachment member to said vehicle seat.

3. An exercise system for use in a motor vehicle as recited in claim 2 wherein said means for removably securing said seat attachment member to said vehicle seat comprises a buckle attached to said first end of said seat attachment member, said buckle being structured to secure said second end of said seat attachment member therein, thereby securing said seat attachment member to said vehicle seat.

4. An exercise system for use in a motor vehicle as recited in claim 1 wherein said means for gripping said tension members comprises a handle.

5. An exercise system for use in a motor vehicle as recited in claim 4 wherein said handle comprises a length of nylon webbing having a pair of opposite ends attached to one another and a foam tube surrounding a portion of said nylon webbing.

6. An exercise system for use in a motor vehicle as recited in claim 1 wherein said means for preventing said first end zone from being pulled between said vehicle door and said vehicle door frame when said vehicle door is closed comprises an enlarged portion on said first end zone of said door jamb member, said enlarged portion having a thickness greater than the distance between said vehicle door and said vehicle door frame when said vehicle door is closed.

7. An exercise system for use in a motor vehicle as recited in claim 1 wherein said resilient tension member comprises elastic tubing.

8. An exercise system for use in a motor vehicle as recited in claim 2 wherein said door jamb member and said seat attachment member are constructed of nylon webbing.

9. An exercise system for use in a motor vehicle as recited in claim 1 wherein said means for removably attaching said tension members to said second end zone of said door jamb member and said means for removably attaching said tension members to said seat attachment member comprises a loop connector.

10. An exercise system for use in a motor vehicle comprising:

a generally flat, elongate door jamb member having a first end zone, an opposite second end zone and means for preventing said first end zone from being pulled between a vehicle door and a vehicle door frame when said vehicle door is closed, said door jamb member being structured to be secured between said vehicle door and said vehicle door frame, with said first end zone outside of said vehicle and said second end zone inside said vehicle, when said vehicle door is closed, said first end zone having an outer end and a magnetic pad on said outer end, said magnetic pad being structured and disposed for removably securing said outer end to a vehicle roof;

a generally flat, elongate seat attachment member structured for attachment to a vehicle seat and having a first end, an opposite second end and means for removably securing said seat attachment member to said vehicle seat;

at least one resilient tension member;

means for gripping said tension member; and means for removably attaching said tension member to said seat attachment member and said second end zone of said door jamb member.

11. An exercise system for use in a motor vehicle as recited in claim 10 wherein said means for removably securing said seat attachment member to said vehicle seat comprises a buckle attached to said first end of said seat attachment member, said buckle being structured to secure said second end of said seat attachment member therein, thereby securing said seat attachment member to said vehicle seat.

12. An exercise system for use in a motor vehicle as recited in claim 10 wherein said means for gripping said tension members comprises a handle.

13. An exercise system for use in a motor vehicle as recited in claim 12 wherein said handle comprises a length of nylon webbing having a pair of opposite ends attached to one another and a foam tube surrounding a portion of said nylon webbing.

14. An exercise system for use in a motor vehicle as recited in claim 10 wherein said means for preventing said first end zone from being pulled between said vehicle door and said vehicle door frame when said vehicle door is closed comprises an enlarged portion on said first end zone of said door jamb member, said enlarged portion having a thickness greater than the distance between said vehicle door and said vehicle door frame when said vehicle door is closed.

15. An exercise system for use in a motor vehicle as recited in claim 10 wherein said resilient tension member comprises elastic tubing.

16. An exercise system for use in a motor vehicle as recited in claim 10 wherein said door jamb member and said seat attachment member are constructed of nylon webbing.

17. An exercise system for use in a motor vehicle as recited in claim 10 wherein said means for removably attaching said tension members to said seat attachment member and said second end zone of said door jamb member comprises a loop connector.

18. An exercise system for use in a motor vehicle comprising:

a generally flat, elongate door jamb member having a first end zone, an opposite second end zone and an enlarged portion on said first end zone of said door jamb member having a thickness greater than the distance between a vehicle door and a vehicle door frame when said vehicle door is closed, said enlarged portion being strictured for preventing said first end zone from being pulled between said vehicle door and said vehicle door frame when said vehicle door is closed, said door jamb member being structured to be secured between said vehicle door and said vehicle door frame, with said first end zone outside of said vehicle and said second end zone inside said vehicle, when said vehicle door is closed, said first end zone having an outer end and a magnetic pad on said outer end, said magnetic pad being structured and disposed removably securing said outer end to a vehicle roof;

a generally flat, elongate seat attachment member structured for attachment to a vehicle seat and having a first end, an opposite second end and means for removably securing said seat attachment member to said vehicle seat;

at least one resilient tension member;

means for gripping said tension member; and means for removably attaching said tension member to said seat attachment member and said second end zone of said doorjamb member.

19. An exercise system for use in a motor vehicle as recited in claim 18 wherein said means for removably securing said seat attachment member to said vehicle seat comprises a buckle attached to said first end of said seat attachment member, said buckle being structured to secure said second end of said seat attachment member therein, thereby securing said seat attachment member to said vehicle seat.

20. An exercise system for use in a motor vehicle as recited in claim 18 wherein said means for gripping said tension members comprises a handle.

21. An exercise system for use in a motor vehicle as recited in claim 20 wherein said handle comprises a length of nylon webbing having a pair of opposite ends attached to one another and a foam tube surrounding a portion of said nylon webbing.

22. An exercise system for use in a motor vehicle as recited in claim 18 wherein said resilient tension member comprises elastic tubing.

23. An exercise system for use in a motor vehicle as recited in claim 18 wherein said doorjamb member and said seat attachment member are constructed of nylon webbing.

24. An exercise system for use in a motor vehicle as recited in claim 18 wherein said means for removably attaching said tension members to said seat attachment member and said second end zone of said door jamb member comprises a loop connector.

* * * * *